US005348234A

United States Patent [19]

v.d. Woude

[11] Patent Number: 5,348,234

[45] Date of Patent: Sep. 20, 1994

[54] CLEANING LANCE MACHINE

[75] Inventor: Meino J. v.d. Woude, Drachten, Netherlands

[73] Assignee: Stork Nedserv B.V., Netherlands

[21] Appl. No.: 55,835

[22] Filed: Apr. 30, 1993

[30] Foreign Application Priority Data

May 4, 1992 [NL] Netherlands ..... 9200799

[51] Int. Cl.[5] ..... F28G 1/16; F28G 15/02

[52] U.S. Cl. ..... 239/753; 239/752; 239/DIG. 13; 134/67 R; 134/171; 165/95; 122/379

[58] Field of Search ..... 239/225.1, 263.1, 263.3, 239/264, 265, 750–753, DIG. 13; 134/167 C, 167 R, 168 C, 168 R, 171, 72; 122/379; 165/95; 15/316.1, 317, 312.1

[56] References Cited

U.S. PATENT DOCUMENTS

| | | | |
|---|---|---|---|
| 1,803,425 | 5/1931 | Cunningham | 239/DIG. 13 |
| 3,869,747 | 3/1975 | Richter | 15/104.095 |
| 3,938,535 | 2/1976 | Cradeur et al. | 134/167 C |
| 5,022,463 | 6/1991 | Boisture | 165/95 |
| 5,031,691 | 7/1991 | Boisture | 122/379 |
| 5,129,455 | 7/1992 | Boisture | 122/379 |
| 5,184,636 | 2/1993 | van der Woude | 122/379 |

FOREIGN PATENT DOCUMENTS 2347113 11/1977 France .

*Primary Examiner*—Karen B. Merritt
*Attorney, Agent, or Firm*—Mark Zovko

[57] ABSTRACT

A device for cleaning heat exchanger pipe bundles. The device includes a guide column supported by a support construction for displacement parallel to itself, wherein the guide column defines a guide path for a slide piece guided slidably along the column, a number of lances connected to the slide piece parallel to the guide column, a hose connected to the slide piece for supplying liquid under high pressure to the lances, and an endless flexible member engaging on the slide piece for reciprocally moving the slide piece along the guide column. The column and the flexible member are assembled from a number of parts so that they can have a length adapted to the conditions.

8 Claims, 4 Drawing Sheets

CLEANING LANCE MACHINE

The invention relates to a device for cleaning heat exchanger pipe bundles.

A device for cleaning heat exchanger pipe bundles is per se known, for instance from the Netherlands patent application 91 01412. Such a known cleaning lance machine comprises a lance holder which is positioned by means of a crane in front of a pipe bundle whereafter a number of lances are pushed out of the holder and into the pipes of the pipe bundle, wherein cleaning liquid is sprayed at high pressure through the lances. This known device can clean large and heavily contaminated heat exchanger pipe bundles economically with a large capacity.

The invention has for its object to provide a device in which smaller pipe bundles can be cleaned in economic manner and which is also particularly suitable for use in limited spaces, in particular also in limited space above vertically disposed heat exchangers.

This object is achieved with the device characterized herein. In this device the guide column is at maximum only slightly longer than the lances, that is, therefore the height or length of the heat exchanger, and such a space is generally sufficiently available. Due to the support construction the guide column is supported for easy displacement so that successive groups of pipes can be cleaned. The operatives have to apply only little or no force to position the lances.

The guide column can be assembled stepwise in any desired length, so that operation can also take place properly in limited spaces. Simultaneously with the addition or removal of one or more column parts one or more parts of the flexible member are added or removed so that the drive means can also be simply adapted to the desired length of the guide column.

Mounting of the column portions and the drive means can herein take place quickly when in a favourable manner the step of claim 3 is applied.

Further favourable steps are stated in the sub-claims and the advantages thereof will become apparent from the following description with reference to the annexed figures of a preferred embodiment of the device according to the invention.

Figure 1:
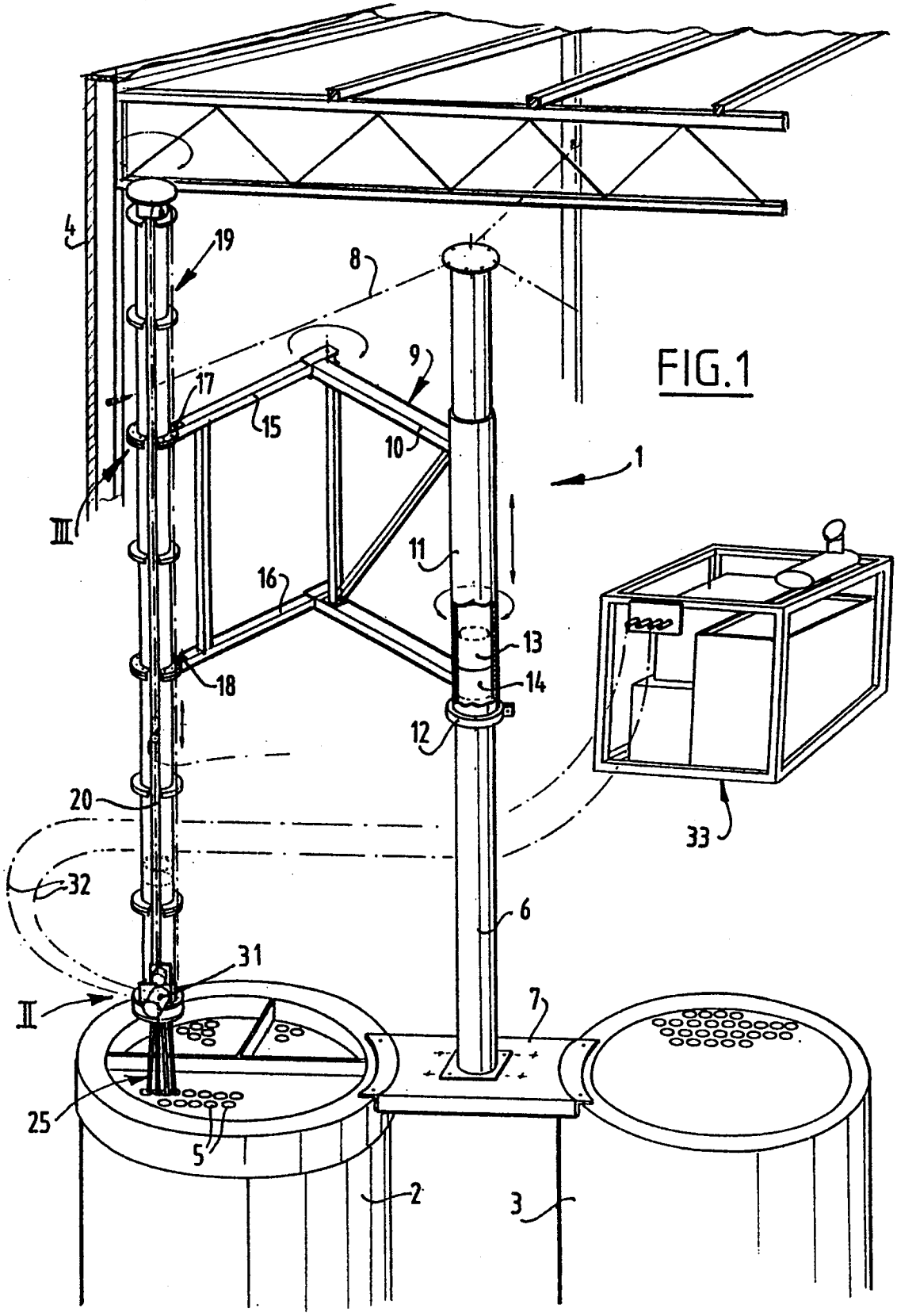
FIG. 1 shows a perspective view of a preferred embodiment of the device in a vertical situation of use.

The device 1 shown in FIG. 1 is intended for cleaning vertical pipe bundles of heat exchangers 2 and 3. These heat exchangers 2 and 3 are disposed in a factory building 4 so that the space thereabove is limited. Each heat exchanger 2, 3 comprises a number of pipe bundles comprising pipes 5. Although only two heat exchangers 2, 3 are drawn, it will often occur that a number of heat exchangers are disposed pairwise in a row. The shown embodiment of the device according to the invention can in one disposition treat two adjacently placed heat exchangers at a time.

The device 1 comprises a support construction with a post 6 which stands by means of a support 7 on the two heat exchangers 2, 3. The upper part of post 6 is fixed using three guy wires 8.

Mounted on the post 6 is an arm construction 9. This latter comprises a frame 10 fixedly connected to a sleeve 11 rotatable about the post 6. The sleeve 11 is supported against a displaceable support ring 12 so that the arm construction can be adjusted to a suitable height.

As shown, the post 6 is assembled from a first post part 13 and a second post part 14. The latter comprises a pipe portion protruding into the first post part 13. Due to the divisible embodiment of the post it is easily movable inside the limited space of building 4.

Figure 3:
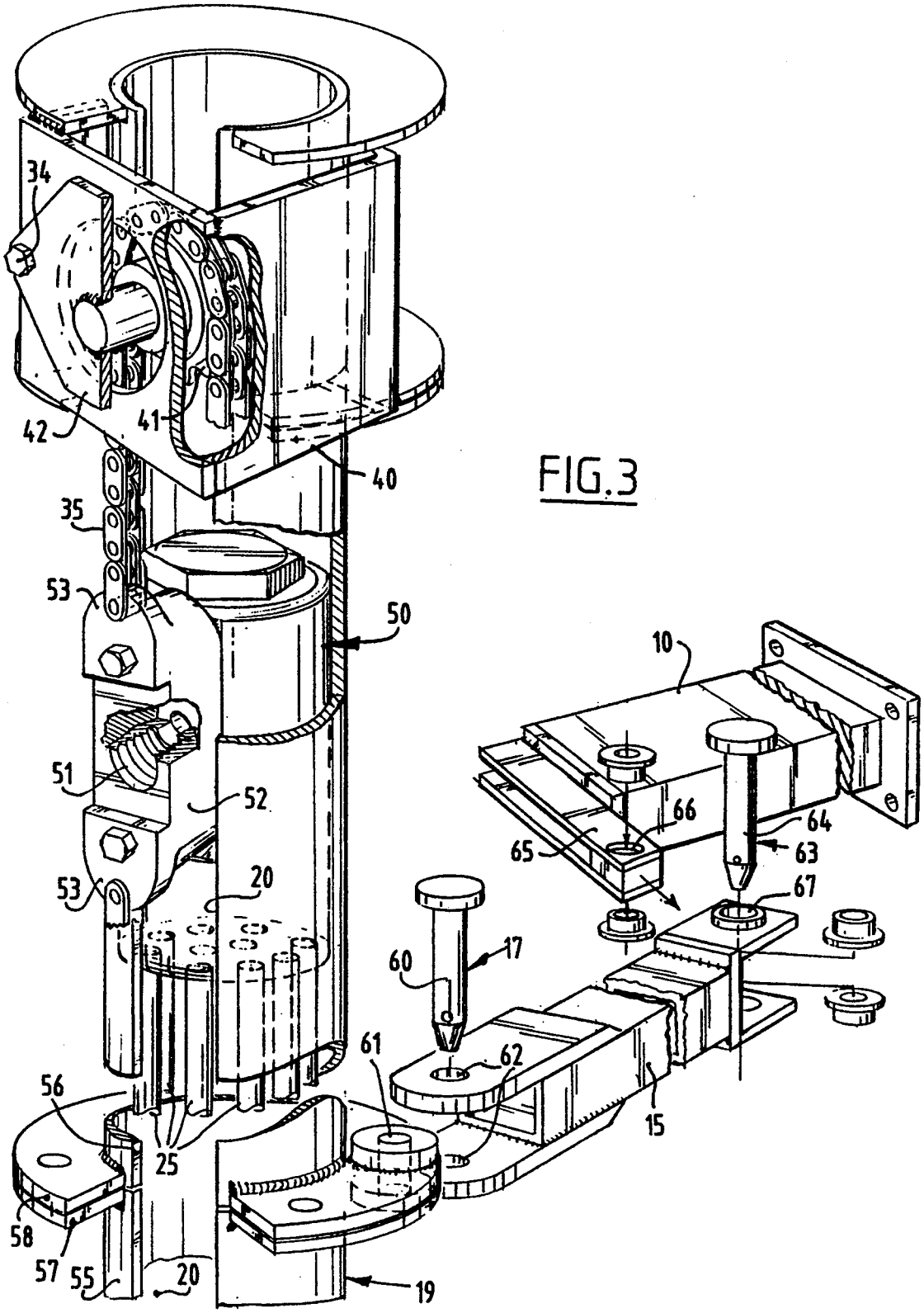
FIG. 3 shows a partial view of the device according to arrow III in FIG. 1.

On the side remote from the sleeve 11 two arms 15, 16 are arranged hingedly on the frame 10 by means of a hinge construction to be elucidated with reference to FIG. 3. These arms 15, 16 are in turn connected via a hinge construction 17, 18 to a guide column 19. Due to the support of the arm construction 9 the guide column 19 can be displaced parallel to itself and also be rotated on a vertical axis by the hinges 17 and 18.

The guide column 19 is intended to guide a number of lances 25 which can simultaneously clean a number of adjacent pipes 5 of a pipe bundle. Due to the described support configuration, the extremities of the lances 25 can thus be positioned for any random group of pipes 5.

In the embodiment of the device as shown the guide column 19 is embodied as a hollow cylindrical tube of an aluminium alloy which has a longitudinal slot 20. Arranged on the bottom end of the guide column is a guide block 26 through which the lances 25 are guided.

During use an adjusting block 27 is positioned at a distance under the guide block 26. The adjusting block 27 is provided with a number of guide sleeves 28 which can be set to desired mutual positions by means of adjusting bolts 29. The adjustment takes place such that the lances 25 placed through the sleeves 28 come to lie at mutual distances corresponding with the mutual distances of the pipes 5 of the pipe bundle for cleaning.

The sleeves 28 can run through to the guide block 26 so that the adjusting block 27 is fixedly connected thereto.

Figure 2:
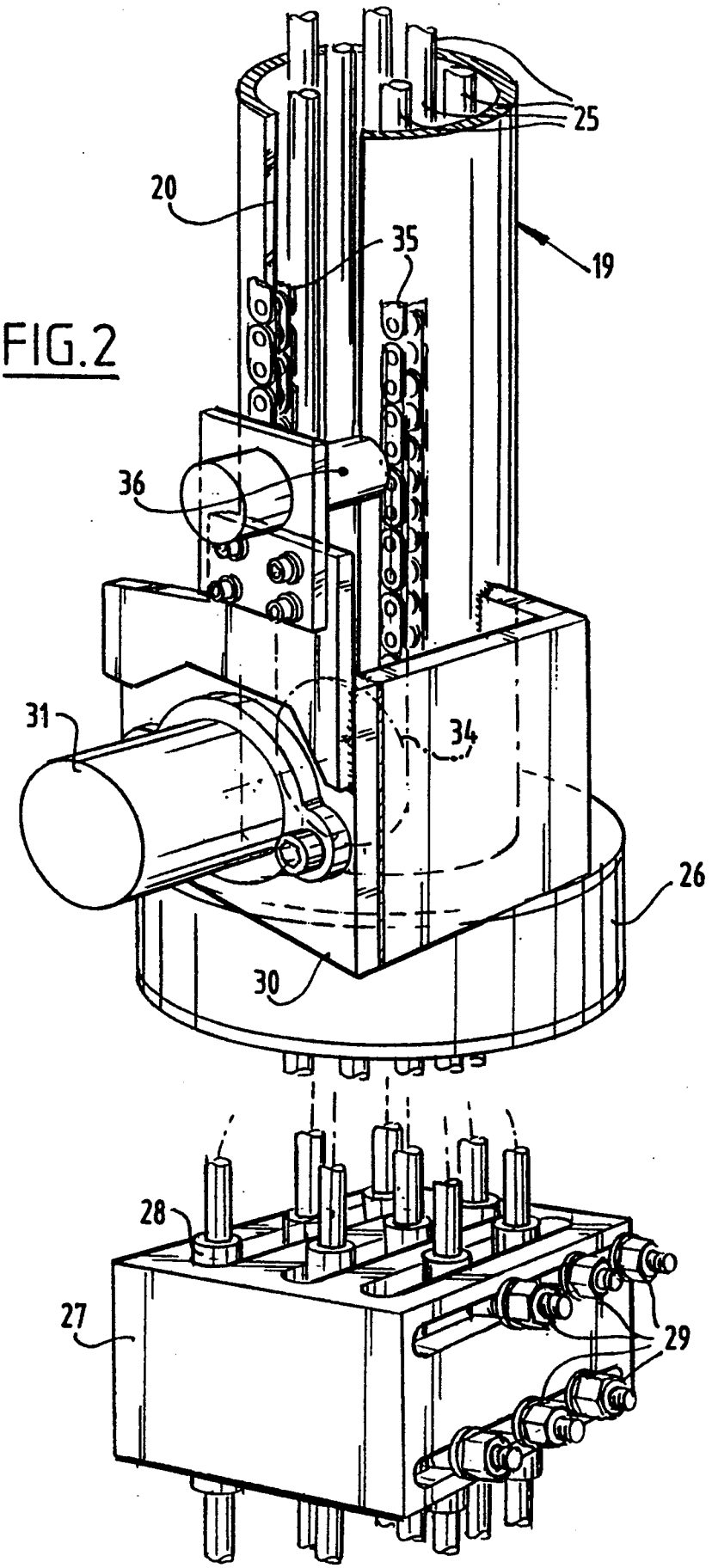
FIG. 2 shows a partial view of the device according to arrow II in FIG. 1.

As shown further in FIG. 2, a support 30 is fixedly welded to the column 19 just above the guide block 26, on which support is mounted a hydraulic motor 31. Mounted on the output shaft of this hydraulic motor 31 is a schematically depicted chain wheel 34 around which is trained a roller chain 35. Further present is a sensor 36 which will be discussed below.

The hydraulic motor 31 is connected via a line 32 shown in FIG. 1 to a hydraulic aggregate 33. The guide column 19 thus bears a minimum weight of components required for driving a slide piece connected to the lances which will be further described hereinbelow.

As shown in FIG. 3, a support 40 is also fixedly welded to the top of column 19. A carrier 42 is mounted for limited vertical displacement on this support 40 by means of a bolt connection 34. The carrier 42 supports on a protruding shaft a free-running sprocket wheel 41 around which is trained the chain 35.

As FIG. 3 further shows, a slide piece 50 is received in the tubular guide column 19, which piece has an engaging part 52 protruding outward through slot 20. The engaging part 52 has a lug 53 at the top and bottom on which the ends of chain 35 engage.

It will be apparent that by setting the hydraulic motor 31 into operation the chain 35 can be driven reciprocally and the slide piece 50 can therein be moved up and downward in the guide column 19.

The above mentioned lances 25 are fixedly mounted in slide piece 50. In the interior of slide piece 50 are formed channels which connect a connection 51 in the engaging part 52 to the lances 25. Onto the connection 51 is connected a high pressure hose which can feed cleaning liquid under high pressure to the lances.

As can be seen in the figures, the column 19 in the embodiment shown is assembled from a number of column portions, two of which, column portion 55 and column portion 56, are shown in more detail in FIG. 3. The column portions are provided on their ends with flanges 57, 58 and can be mutually connected in per se known manner by means of bolts placed through the flanges to form a suitable length of the guide column. With respect to its length the guide column 19 can be adapted simply to the space available in the building 4.

Herein the chain 35 is assembled from a number of chain portions with a length equal to twice the length of a column portion 55, 56. The chain portions are easily connected to each other by connecting links to form a whole. Chain 35 comprises substantially the same number of chain portions as column portions are used in the column 19.

FIG. 3 also shows in detail parts of the arm construction 9. The frame 10 bears a protruding portion 65 which has on its end a hinge bore 66. Bores 67 in a fork on the arm 15 fit over this hinge bore 66. A hinge pin 64 is placed through the aligned bores, thus forming a hinge 63.

The connection of the arm 15 to column 19 can also be seen in FIG. 3. On the end of the arm close to the column 19 the arm 15 bears a fork with two bores 62 at a mutual distance. The fork fits over a thickened portion of the mutually connected flanges 57 and 58, through which is arranged a hinge bore 61. A hinge pin 60 is arranged through the aligned bores 61 and 62 so that hinge 17 is formed. Hinge 18 is embodied in identical manner. The connection of arm 16 to frame 10 is likewise embodied in identical manner as hinge 63.

The arms 15, 16 can thus be very simply detached on the one side from the frame 10 and on the other from the column 19 so that the whole device can be rapidly built up and stripped down.

In operation, after building up the device 1 and setting the adjusting block 27, the slide piece 50 with the lances 25 connected thereto is moved fully upward in column 19 by setting into operation the hydraulic motor 31. The lances 25 are then retracted almost entirely into the adjusting block 27. Column 19 can then be moved above the top surface of heat exchanger 2 and be rotated on an axis defined by the hinges 17 and 18 until the lances 25 come to lie in line with a group of pipes 5 of the pipe bundle of heat exchanger 2. The lances are then moved slightly downward into the pipes, whereafter the feed of cleaning liquid (not shown) under high pressure is switched on so that via connection 51 and slide piece 50 cleaning liquid is sprayed at high pressure through the lances 25 at the end thereof. The scale and deposits present in pipes 5 are hereby sprayed loose. When the feed of cleaning liquid under pressure is switched on, the lances 25 are moved fully downward so that the whole length of the pipes 5 is treated. The lowest position is detected by the sensor 36. The direction of movement of motor 31 is then reversed and slide piece 50 is moved upward again wherein the spray nozzles of lances 25 once again brush against the inner wall of pipes 5. When the lances 25 are moved fully upward the high pressure source is switched off and column 19 is positioned above a following set of pipes 5. Practically no force is required herefor, since the weight of column 19 and all the parts connected thereto is absorbed by the bearing arm construction 9.

After all pipes of the pipe bundle of the heat exchanger 2 have thus been treated the column 19 can be pivoted above heat exchanger 3 and the cycle can once again be repeated for the pipe bundle therein.

Due to the preferred embodiment of the device wherein column 19 is constructed from column portions of an aluminium alloy and the chain assembled from chain portions the device can be used practically as an entity at different locations. Only the set of lances for treating the whole pipe length of the heat exchanger will have to have the correct length.

Figure 4:
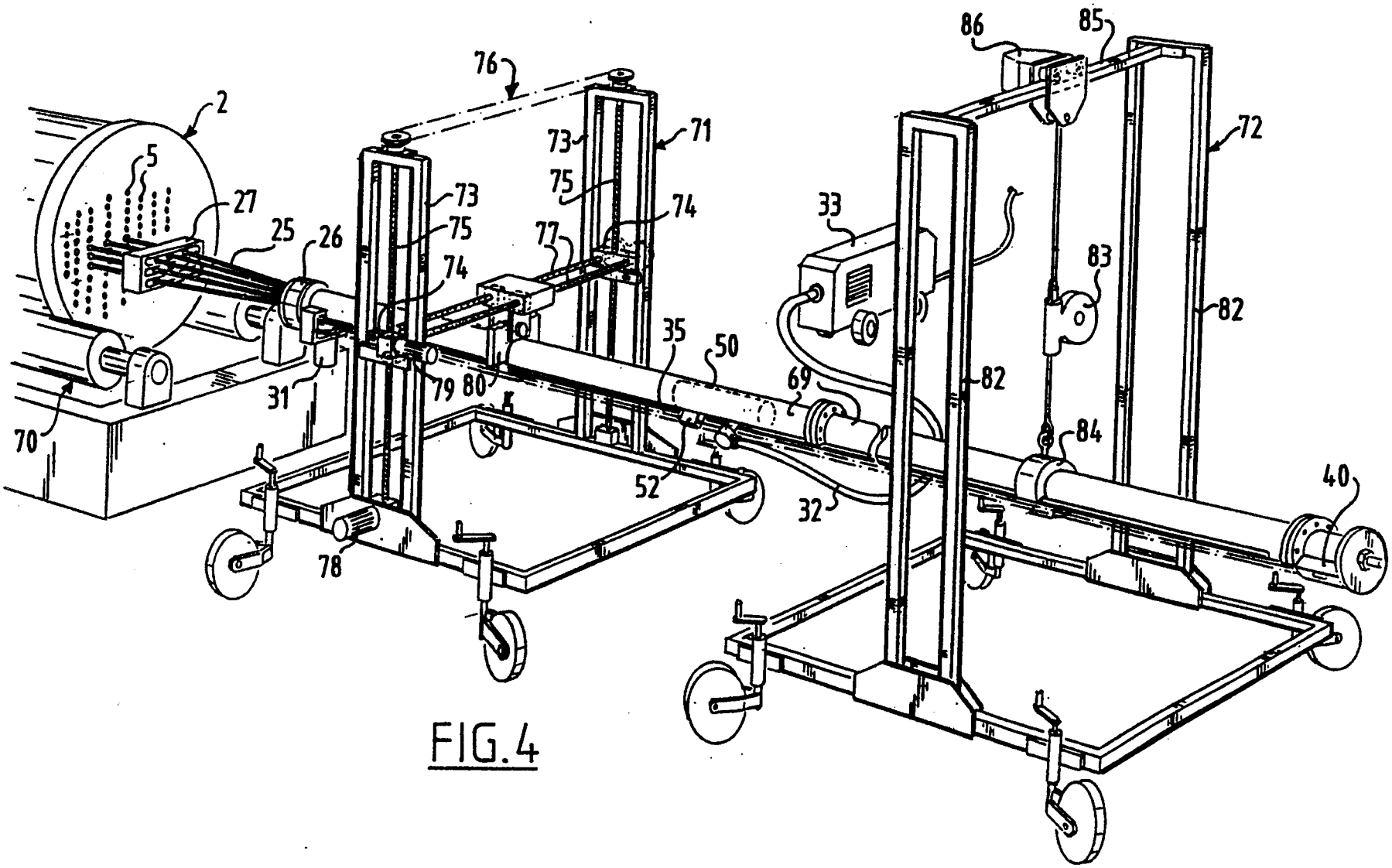
FIG. 4 shows a perspective view of a device according to the invention in a horizontal situation of use.

In FIG. 4 a device according to the invention is used for cleaning a pipe bundle with horizontally lying pipes. In this figure components which correspond with or are the same as components shown in the preceding figures are designated with the same reference numerals and are not further described here.

The guide column of the device shown in FIG. 4 is here also assembled from a number of parts. In this case two column portions 69 which each have a greater length than the parts of the column shown in FIG. 1.

The pipe bundle 2 for cleaning is drawn in FIG. 4 supported on a roller support 70. This is usually used when it is necessary to clean the exterior of the pipes 5 of pipe bundle 2.

The device according to the invention is however, as described, very suitable for cleaning pipe bundles in situ, also when only little space is available for the pipe bundle. The device is brought simply to a suitable length by mutually connecting a suitable number of column portions 69.

The support construction for the cleaning device consists of two mobile support constructions 71 and 72. The leading support constructions 71 comprises two posts 73 each serving as vertical guides for carriages 74. Engaging on each of these carriages 74 is a vertical screw spindle 75. The screw spindle 75 on the left in the figure is driven directly by a drive 78 and the right-hand screw spindle is driven synchronously from the left-hand screw spindle by means of a transmission 76. By switching on the drive 78 the screw spindles 75 are rotated synchronously whereby the carriages 74 move synchronously up or downward.

Also mounted on the carriages 74 are two horizontal screw spindles 77 which are in engagement with a support 80. Screw spindles 77 can be set into rotation by means of the drive 79. When the drive 79 is switched on the support 80 moves in horizontal direction. By switching on the drives 78 and 79 in suitable manner the lances 25 of the device can be manoeuvred in front of the desired pipes 5 of pipe bundle 6.

The rear end of the guide column is supported using the second support construction 72. This likewise comprises two posts 82. The top ends of these posts 82 are connected by a cross beam 85 which must serve as guide rail for a carriage 86, which can thus move reciprocally in transverse direction. Suspended from this carriage 86 is a so-called balancer which carries a support 84 which is connected to the guide column of the cleaning device. Balancer 83 is adjusted in usual manner such that it compensates the weight suspended therefrom. The guide column is thus supported substantially horizontally, wherein the height is determined by the described support construction 71.

When the available space outside the heat exchanger permits, it is of course also possible to work with a longer machine. In that case the stroke of the lances is monitored using the sensor 36 which for instance generates a signal in proportion with the extended length of the lances. Using a suitable processing/indicator device this signal is used to control the drive means.

I claim:

1. Device for cleaning heat exchanger pipe bundles comprising a guide column supported by a support construction for displacement parallel to itself, wherein the guide column defines a guide path for a slide piece guided slidably along the column, a number of lances connected to the slide piece parallel to the guide column, means connected to the slide piece for supplying liquid under high pressure to the lances, and drive means engaging on the slide piece for reciprocally moving the slide piece with the lances connected thereto along the guide column, wherein the guide column is assembled in lengthwise direction from a number of column portions, the drive means comprise an endless flexible member engaging on the slide piece and extending round guide wheels on each end of the guide column, wherein one of the guide wheels is arranged on the output shaft of a drive gear and wherein the endless flexible member is assembled from a number of detachable portions having double the length of a column portion.

2. Device as claimed in claim 1, wherein the drive gear comprises a hydraulic motor connected by hoses to a hydraulic aggregate.

3. Device as claimed in claim 1, wherein the flexible member is a roller chain assembled from connecting links.

4. Device as claimed in claim 1, wherein the guide column is hollow and has a longitudinal slot, the guide path is defined in the interior of the column and the slide piece received in the interior of the column comprises an engaging part protruding through the longitudinal slot and connected to the drive means.

5. Device as claimed in claim 4, wherein in the slide piece and through the engaging part thereof is formed a high pressure liquid channel connected to the lances and the means for supplying liquid under high pressure to the lances comprises a pump unit connected by a high pressure hose to the engaging part.

6. Device as claimed in claim 1, wherein the support construction comprises a substantially rectangular frame pivotable on the vertical longitudinal axis of a post and two arms connected to the frame and pivotable on a vertical axis on one end and which on their other end are connected rotatably on a vertical axis to the guide column.

7. Device as claimed in claim 1, wherein the column portions are mutually connected by flange connections.

8. Device as claimed in claim 1, wherein the column portions are manufactured from an aluminium alloy.

* * * * *